United States Patent [19]

Schmieder et al.

[11] 4,330,989

[45] May 25, 1982

[54] FALSE-TWIST-TEXTURED SYNTHETIC POLYMER FILAMENT YARN

[75] Inventors: Heinrich Schmieder; Rolf Heider, both of Emmenbrucke, Switzerland

[73] Assignee: Viscosuisse S.A., Emmenbrucke, Switzerland

[21] Appl. No.: 157,704

[22] Filed: Jun. 9, 1980

[30] Foreign Application Priority Data

Jun. 7, 1979 [CH] Switzerland ..... 5297/79

[51] Int. Cl.[3] ..... D02G 3/38; D02G 3/04

[52] U.S. Cl. ..... 57/227; 57/228

[58] Field of Search ..... 57/210, 225, 226, 227, 57/228, 230, 243, 244, 245, 246, 247; 28/281; 428/369, 370, 399, 394, 395

[56] References Cited

U.S. PATENT DOCUMENTS

| | | | |
|---|---|---|---|
| 3,013,379 | 12/1961 | Breen | 57/6 |
| 3,344,596 | 10/1967 | Spicer et al. | 57/6 X |
| 3,396,529 | 8/1968 | Stutz | 57/140 |
| 3,438,193 | 4/1969 | Kosaka et al. | 57/228 |
| 3,988,883 | 11/1976 | Sze | 57/227 X |

FOREIGN PATENT DOCUMENTS

| | | |
|---|---|---|
| 1915821 | 10/1969 | Fed. Rep. of Germany . |
| 2255460 | 5/1974 | Fed. Rep. of Germany . |
| 7105980 | 12/1971 | France . |
| 1234250 | 6/1971 | United Kingdom . |
| 1488255 | 10/1977 | United Kingdom . |

*Primary Examiner*—Donald Watkins

*Attorney, Agent, or Firm*—Seidel, Gonda, Goldhammer & Panitch

[57] ABSTRACT

The invention is directed to filament yarns made from synthetic polymers and having false-twist texture, comprising a core filament group and a sheath filament group wrapped around and partially covering the core. The sheath filament group comprises at least two filament groups 4 and 5 with different cross-sections, the smaller component of the sheath filament group including fibrils with the coarsest denier, and the larger component of the sheath filament group containing fibrils with the finer fibril denier, the finer fibrils in the filament group having a lesser fibril denier than the fibrils 3 of the core group 1.

9 Claims, 7 Drawing Figures

FALSE-TWIST-TEXTURED SYNTHETIC POLYMER FILAMENT YARN

BACKGROUND OF THE INVENTION

The invention concerns a false-twist-textured filament yarn of synthetic polymers, comprising a filament group forming the core and a filament group on the outside of the core and partially wrapped around the core, wherein the two filament groups are produced from the same or different polymers. Further, the invention concerns a procedure for manufacturing the above mentioned filament yarn.

In the last several years, the interest in synthetic filament yarns resembling natural fiber yarns has been steadily increasing. The closer the similarity with natural fiber yarns, the better the so-called "spun-like effect". In the last few years, core-wrapping threads have gained greater importance, since a relatively good spunlike effect can be obtained with such threads. For example, German patent applications Nos. DE-OS 19 15 821 and 22 55 460 concern a procedure for manufacturing synthetic continuous core yarns of false-twist-texture, which consist of at least one core component and one sheath component, whereby both polyamide and polyester have been used.

According to this procedure, core yarns with good spunlike effect can be manufactured, but when these core yarns are to be processed, for example on a knitting machine, great problems occur due to frequent machine shut-offs. The presence of small fibrils extending from the sheath thread causes great back-holding-force in the knitting, which must be overcome in order to continue the knitting procedure. Since great back-holding-force leads to deficiencies in the produced knitted goods, shut-off devices are applied to the knitting machines which shut off the machine when the back-holding-force becomes too great. A large number of shutdowns, as will occur with these core yarns, is not economical for the processor.

On the other hand, German utility model DE-GM No. 77 34 062 describes a voluminous false-twist-textured polyester filament yarn, consisting of a core with between 12 and 100 fibrils and a sheath with between 1 and 10 fibrils, wherein the fibrils of the core group have a lesser denier than the fibrils of the sheath group. The yarn according to the abovementioned utility model has a crepe-like effect, not a spunlike effect; on the other hand, it runs quite well on the machine, i.e. there is little back-holding-force in the knitting, which causes almost no shut-downs during the knitting.

The purpose of the present invention is to make available a filament yarn with false-twist-texture, comprising a filament group forming the core and a filament group wrapped around the core, whereby the abovementioned disadvantages can be avoided. It concerns the production of a filament yarn which has a good spunlike effect and runs well during the processing, for example in knitting machines.

BRIEF SUMMARY OF THE INVENTION

According to the present invention, this problem is solved in that the sheath filament group comprises at least two filament groups with different cross sections, in which the smaller component of the sheath filament group includes the fibrils with the greatest fibril denier and the greater component of the sheath filament group includes the fibrils with the finer denier, and the finer fibrils of the sheath filament group have a lesser fibril denier than the fibrils of the core group. According to the invention, it is preferable that the sheath filament group comprise two filament groups with different cross sections.

In addition to a very good spun-like effect, a filament yarn according to the invention also has good working characteristics for further processing in knitting machines, twisting machines, weaving machines, etc. The fibrils of the sheath filament group, particularly the coarsest fibrils, develop alternating helicals along the thread, which wrap around the core thread. Any fiber-forming polymers can be used. Polyamides (PA), polyester (PES) or their copolymers are preferred, while desired combinations such as PES-PES, PA-PA, PES-PA, etc. can be utilized.

According to a further characteristic of the invention, the sheath group has more fibrils than the core group, preferably in a ratio between 2:1 and 5:1. However, it is also possible that the number of fibrils for core and sheath filaments be approximately the same.

According to the invention, the coarser fibrils of the sheath filament group have a fibril denier of up to ten times greater than the finer fibrils, preferably 2 to 3 times greater. The denier of the core and sheath groups combined is from 50 to 800 dtex, deniers between 150 and 500 dtex are preferred.

In order to obtain a core yarn with good spun-like effect and good workability, the sheath group contains 1 to 10 coarse fibrils, depending on the denier of the core yarn, two or three coarse fibrils in the sheath group being preferred for a core yarn denier of from 150 to 250 dtex. The good characteristics of this thread are retained if the sheath group has 1 to 10 coarse fibrils. With increasing numbers of coarse fibrils in such a core yarn, the materials produced will feel harsher.

Furthermore, the invention includes a procedure for production of the abovementioned filament yarn, namely spinning two molten spinning solutions for core and sheath filament groups from fiber-forming polymers out of separate bores, combining the group of fibrils after cooling, e.g. with forced air, providing with spinning preparation, winding them on a yarn carrier and subsequently false-twist-texturizing them, this process is characterized in that spinning nozzles are used, the bores of which are provided with varying capillary diameters and/or capillary lengths for the coarsest and finer fibrils of the sheath group in such a manner that the bores for the coarsest fibrils are arranged on the side away from the blower orifice. If the bores for the coarsest fibrils are not located on that side of the spinning nozzles which is opposite to the air cooling orifice, the coarsest and the finer fibrils will come into contact with each other due to the greater movement of the coarsest fibrils through the cooling air, causing interruptions in the spinning process and frequent breakages of the thread.

According to one embodiment of the procedure according to the invention, the core filament and the sheath filament groups are spun separately from the same or different polymers. The sheath filament group consists of a greater number of fibrils with finer fibril denier and of a smaller number of fibrils with the coarsest fibril denier, which are obtained by means of spinning nozzle bores with different capillary diameters and/or different capillary lengths. The sheath filaments are spun at a specific speed X and the core filaments at a specific spinning speed Y, whereby the speed X is equal to or less than the speed Y for most polymer combinations. These two threads are wound on separate spools. Usually, the speed X is in the range of 1,000 to 3,500 m/min. The two partially stretched threads will then be combined on a false-twist-stretch texturizing machine prior to the first creel, where they are false-twist-stretch textured under heat treatment in the usual manner, fixed, and finally wound. It is also possible to entangle the texturized thread by conventional blower means before winding it. The following of such a procedure makes it possible to produce a filament yarn according to the invention, which has not only a very good spun-like effect but also runs well in the further processing. The schematic view of a yarn produced in this manner is shown in FIG. 1.

According to another embodiment, it is possible to produce the filament yarn in a co-spinning process. In this case, the two polymers used for core and sheath are spun simultaneously through separate spinning nozzle holes in a single pack of spinning nozzles. In this procedure according to the invention, two molten spinning solutions of different thread-forming polymers for core and sheath filament groups are conducted to a common pack of spinning nozzles, the two solutions for core and sheath filament groups are spun simultaneously from separate bores of the common spinning nozzle pack, the groups of fibrils are combined after cooling, e.g. with cool air, into a mixed yarn, the mixed yarn is provided with spinning preparation, and the mixed yarn is wound on a yarn carrier. Subsequently, the wound mixed yarn is texturized on a false-twist-stretch texturizing machine. Co-spinning rates of up to 6,000 m/min are possible. A winding speed of approximately 2,500 to 4,000 m/min is preferred. According to this second embodiment, it is also possible to produce the yarn in an integrated co-spinning-texturizing procedure instead of first winding and then texturizing it. In this case, one uses a mechanism which allows spinning and texturizing in two sequential steps without an intermediate winding step and in a single machine. The texturized thread can be entangled prior to the winding.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF PREFERRED EMBODIMENTS

Figure 1:
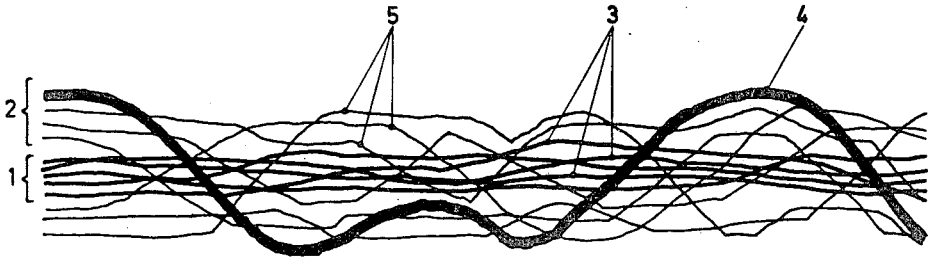
FIG. 1 is a schematic view of a filament yarn according to the invention with two filament groups of different cross-sections for the sheath.

As FIG. 1 shows, the filament yarn according to the invention has a core filament group 1, consisting of several individual fibrils 3, and a sheath filament group 2, consisting of a coarse fibril 4 and finer fibrils 5. As can be seen from FIG. 1, the core fibrils 3 have a greater denier than the finer sheath fibrils 5. Further, the number of core fibrils is less than that of the sheath fibrils. The fibrils 4 and 5 form spirals along the thread and are wrapped around the core. FIG. 1 also explains the good spun-like effect of these threads, occurring through the longer, separated fibrils of the sheath group, which produces an appearance similar to that of natural fibers and a material which is pleasant to the touch. The use of coarser fibrils allows a satisfactory behavior of these threads in the further processing while retaining this good effect. FIG. 1 also shows that the fibrils of the sheath group are longer than the fibrils of the core group, whereby the relative difference in length between core and sheath can be used as a measure of the spun-like effect. Normally this difference in length is between 5% and 25%.

Figure 2:
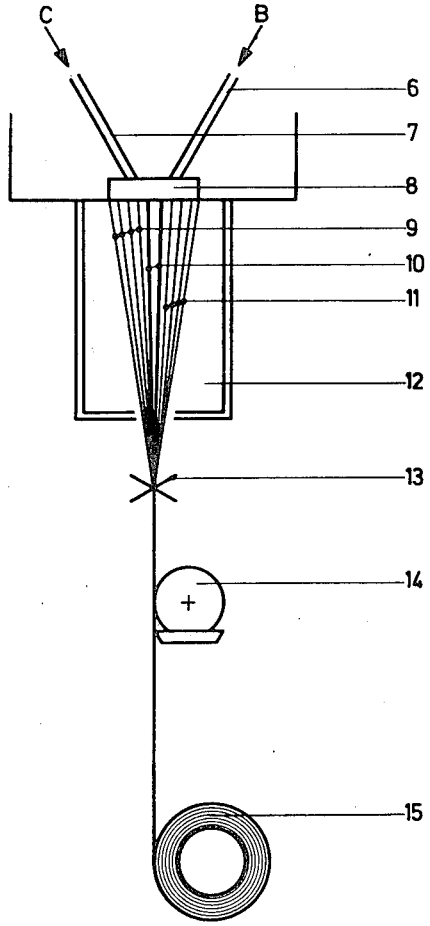
FIG. 2 is a schematic representation of an apparatus for executing the co-spinning process according to the invention.

The apparatus in FIG. 2 makes it possible to produce the filament yarns according to the invention in a co-spinning procedure with two filament groups of different cross-sections forming the sheath group. Two different polymers B and C are supplied in a molten state through separate intakes 6 and 7 of a common spinning nozzle pack 8. This pack of spinning nozzles has small and, as an example, two larger bores for spinning of polymer C, as well as other bores for the spinning of polymer B. Thin individual threads 9 and thick individual threads 10 of polymer C exit from the spinning nozzle, combining to form the sheath group; and there also emerge the individual threads 11 of polymer B, which form the core group. These three groups of individual threads converge at 13. Between this convergence point 13 and the spinning nozzle pack 8, the individual threads are cooled, e.g. by means of air forced through the cooling air orifice 12. The combined thread is then provided with a spinning preparation by means of the roller 14, and is finally wound on a spool 15. In order to produce a filament yarn according to the invention, the spun yarn must be texturized in a false-twist-stretch texturizing machine. This texturizing of the thread is performed according to the usual method.

Figure 3A:
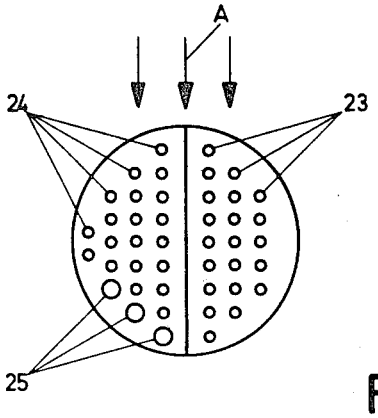
FIGS. 3*a*, 3*b* and 3*c* illustrate several spinning nozzles, seen from the output side, adaptable to the apparatus shown in FIG. 2.
Figure 3B:
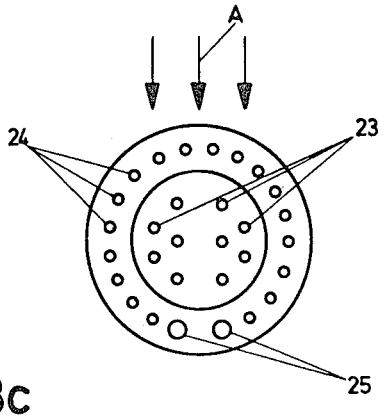
Figure 3C:
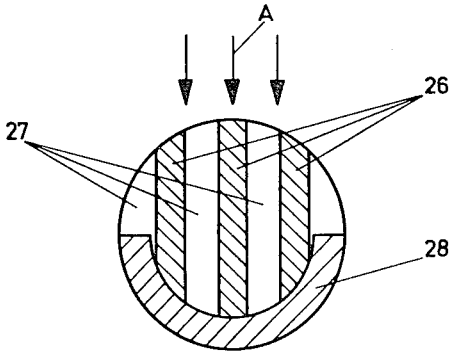

FIGS. 3*a* through 3*c* show different spinning nozzles which can be applied to the apparatus shown in FIG. 2. As mentioned above in respect to the co-spinning procedure, one uses a spinning nozzle, the bores of which are so arranged that the larger bores 25 in FIGS. 3*a* and 3*b* for individual threads 10 as shown in FIG. 2 for the sheath group, are positioned on that side of the spinning nozzle which is located away from the direction A of the cooling air. The direction of the cooling air is represented by the arrow A in FIGS. 3*a* through 3*c*. The arrangement of the other bores 24 for the sheath group consisting of the finer individual threads 9 of polymer C in FIG. 2, as well as the arrangement of the bores 23 for the core group, containing the individual threads 11 of polymer B in FIG. 2, can be distributed over two halves of a circle (FIG. 3*a*) or in concentric circles (FIG. 3*b*).

FIG. 3*c* shows a spinning nozzle with different areas for the arrangement of the spinning nozzle openings. The semi-circular area 28 on the side away from the cooling air outlet of the spinning nozzle contains the larger bores for the sheath components of polymer C. Area 27 contains the smaller bores for the sheath components of polymer C, while the area 26 contains the spinning nozzle bores for the core components of polymer B. In addition to the illustrated arrangements of spinning nozzle bores, other arrangements of the bores of the spinning nozzle are also possible.

Figure 4A:
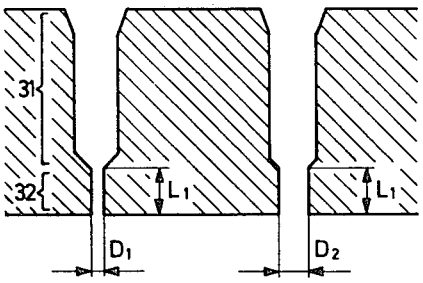
FIGS. 4*a* and 4*b* illustrate sections of spinning nozzles with different bores for the coarsest and finer fibrils of the sheath filament group.
Figure 4B:
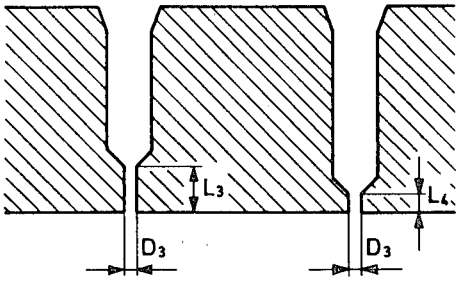

FIG. 4*a* and FIG. 4*b* show sections through spinning nozzles of different bores for the coarsest and finer filaments of the sheath filament group. Most commonly, these bores consist of a pre-bore 31 and a capillary bore 32. Denier and cross section of the fibrils exiting from the bores are determined by the dimension of the capillary bore 32. FIG. 4*a* shows two bores with identical capillary length L1 and different capillary diameters, whereby fine fibrils exit at the small diameter D1 and coarse fibrils at the large diameter D2. FIG. 4*b* shows two bores with identical capillary diameter D3 and different capillary lengths, whereby the bore with the greater capillary length L3 provides fine fibrils and the bore with shorter capillary length L4 provides coarse fibrils.

The advantages of the invention will be explained in greater detail by means of the following illustrative, non-limiting examples.

COMPARISON EXAMPLES 1 AND 2

These experiments describe the production and processing of known threads of one core filament group and one sheath filament group, manufactured in accordance with the state of the technology.

Polyethylene terephthalate pellets were melted in a regular spinning machine and extruded through a spinning nozzle, subsequently cooled with forced air, converged, provided with a preparation, and then wound on a spool. Two experiments were performed, each with one core filament group and one sheath filament group, whereby different polymers, deniers, numbers of fibrils, and spinning speeds were used. In experiment 1, both filament groups were produced from polyethylene terephthalate (referred to as polymer A), while in experiment 2 the core filament group was produced from polyethylene terephthalate with an additive of the sodium salt of the dimethyl ester of sulfoisophthalic acid (referred to as polymer B). In both experiments, the core thread and the sheath thread were processed together on a known stretching nd false-twist-texturizing machine, in which the core thread and the sheath thread were combined prior to the first creel.

In both experiments, a minimum of 36 spools of texturized yarn of each type was produced. The percentage difference in length between core thread and sheath thread was measured. 36 spools of texturized yarn from each experiment were simultaneously processed to knit goods on a round-knit machine MAYER OV 36 for test purposes, and the number of machine shut-downs per kilogram of knitted yarn was recorded. The spun-like effect of the material was evaluated for the finished knit goods. The most significant procedural characteristics for spinning, texturizing, and further processing, as well as the most important characteristics of the threads have been summarized for experiments 1 and 2 in Table 1 below.

TABLE 1

| Experiment | 1 | | 2 | |
|---|---|---|---|---|
| Filament Group | Core | Sheath | Core | Sheath |
| Polymer | A | A | B | A |
| Denier, dtex | 148 | 248 | 104 | 155 |
| Number of fibrils | 16 | 33 | 12 | 36 |
| Spinning speed, m/min | 1,900 | 1,250 | 2,900 | 2,000 |
| Texturizing: | | | | |
| Stretching ratio | | | 2.33 | 1.55 |
| Texturizing heater, °C. | | | 200 | 190 |
| Setting heater, °C. | | | 200 | 190 |
| % difference in length | | | 10 | 16 |
| Further processing: | | | | |
| Shut-downs/kg yarn | | | 15 | 20 |
| Spun-like effect | | Moderate | | Very good |

The further processing characteristics of these two comparison experiments on a round-knit machine are totally unsatisfactory. Such threads are regarded as unacceptable for processing. These experiments also show that the improvement of the spun-like effect in experiment 2 meant a simultaneous deterioration in the number of machine shut-downs per kilogram of yarn.

EXAMPLES 3 THROUGH 5

These examples show the production of filament yarns according to the first embodiment of the invention and the improved processing characteristics.

Three different yarns were produced, wherein the same core thread as in experiment 2 was used for all three yarns, since this would emphasize the advantages of the invention. In the production of the sheath threads, attention was also given to reproducing the production conditions from experiment 2 to the greatest extent possible. For producing the sheath filaments for examples 3, 4, and 5 according to the invention, polyethylene terephthalate pellets were melted, extruded through different spinning nozzles, cooled, combined, provided with preparation, and wound. The spinning nozzles for the sheath filaments of example 3 had 35 capillary bores with a diameter of 0.23 mm and one capillary bore with 0.34 mm diameter. For example 4, the spinning nozzle had 34 capillary bores with a diameter of 0.23 mm and two capillary bores with 0.34 mm diameter. For example 5, spinning nozzles were used which had 26 capillary bores with a diameter of 0.23 mm and 4 capillary bores with 0.34 mm diameter. In each case, the capillary bores with the larger diameter were placed on the side away from the cooling air.

These sheath threads were texturized together with the core threads with the same machine adjustment for stretching and false-twist-texturizing as was used in experiment 2. As before, at least 36 spools of textured yarn were produced from each of examples 3, 4, and 5, and then processed on the same round-knit machine for test purposes. Table 2 below summarizes the most important procedural data and characteristics of examples, 3, 4, and 5.

TABLE 2

| Example | 3 | | 4 | | 5 | |
|---|---|---|---|---|---|---|
| Filament Group | Core | Sheath | Core | Sheath | Core | Sheath |
| Polymer | B | A | B | A | B | A |
| Denier, dtex | 104 | 155 | 104 | 155 | 104 | 155 |
| Number of fibrils | 12 | 35&1 | 12 | 34&2 | 12 | 26&4 |
| Fibril denier, dtex | 8.7 | 4.1&11.8 | 8.7 | 3.9&11.3 | 8.7 | 4.1&12.6 |
| Spinning speed, m/min | 2,900 | 2,000 | 2,900 | 2,000 | 2,900 | 2,000 |
| % difference in length | 14 | | 14 | | 14 | |
| Shut-downs/kg | 7 | | 2 | | 8 | |

TABLE 2-continued

| Example | 3 | | 4 | | 5 | |
|---|---|---|---|---|---|---|
| Filament Group | Core | Sheath | Core | Sheath | Core | Sheath |
| Spun-like effect | Very good | | Very good | | Good | |

As compared to experiments 1 and 2, these examples 3, 4, and 5 according to the invention demonstrate significantly improved characteristics for further processing on round-knit machines, whereby a very good result can be obtained particularly for example 4. The significant improvement of the further processing characteristics could also be confirmed when these yarns were processed on machinery for weaving preparation and on weaving machinery. It should also be stated that this good result could be obtained without negative effect on the very good spun-like effect.

EXAMPLES 6 AND 7

These examples illustrate the production of additional filament yarns according to the invention. For examples 6 and 7, the same polymers were used for production of the core and sheath filament groups as for production of examples 3 through 5. For both examples, the denier of the core thread was 123 dtex, and the core thread had 13 fibrils. In example 6, the sheath filament group had 38 finer fibrils and 2 which were 5.2 times thicker. In example 7, the sheath filament group had 38 finer fibrils and 2 which were 2.2 times thicker. In both examples 6 and 7, core and sheath filament groups were stretched and texturized together, whereby a highly elastic, entangled, false-twist-textured yarn was produced. Prior to the winding, two threads were at times plied, whereby sometimes a textured yarn with a denier of 460 dtex was obtained for each example. The yarns of examples 6 and 7 had a very good spun-like effect, had a difference in length between core and sheath thread of 20%, and caused significantly less difficulties in the further processing of woven goods than was the case in the comparison experiments.

EXAMPLE 8

For example 8, the core thread consisted of polyhexamethyladipamide, which was spun at a rate of 4,200 m/min into a thread with a denier of 98 dtex and 17 fibrils. The sheath thread consisted of polyethylene terephthalate, which was produced at a rate of 2,000 m/min and contained 34 fine and 2 coarse fibrils with deniers of 4.0 and 10.0 dtex. Core and sheath threads were stretched and texturized together. The resulting filament yarn had a difference in length between core and sheath threads of 18% and a denier of 175 dtex. The yarns produced according to this example also had good spun-like effect and favorable processing characteristics for round-knit machines.

EXAMPLE 9

This example illustrates the production of filament yarn according to the second embodiment of the process according to the invention. In a co-spinning installation, molten polyethylene terephthalate with an additive of the sodium salt of the dimethyl ester of sulfoisophthalic acid was used for the core thread and molten polyethylene terephthalate for the sheath thread, supplied via separate lines to a common pack of spinning nozzles and spun through separate bores into a mixed yarn. The arrangement of the spinning nozzle openings corresponded to that shown in FIG. 3*a*. The core thread had 12 fibrils and constituted 40% of the denier of the mixed yarn. The sheath thread, constituting 60% of the mixed yarn denier, had 34 fine and 2 coarse fibrils with fibril deniers of 3.9 and 8.6 dtex, obtained from capillary bores with different diameters. After the cooling, the fibrils were combined, provided with spinning preparation, and finally wound at 3,100 m/min. The denier of the mixed yarn was 250 dtex.

The yarn was forwarded to a false-twist machine and stretched and textured with a stretching ratio of 1.35. The difference in length between core and sheath thread was 12%. The yarn was characterized by good processing qualities for knitting, twisting, and weaving, and produced materials with a good spun-like effect.

The present invention may be embodied in other specific forms without departing from the spirit or essential attributes thereof and, accordingly, reference should be made to the appended claims, rather than to the foregoing specification as indicated the scope of the invention.

We claim:

1. False-twist-textured filament yarn of synthetic polymers, comprising a core filament group and a sheath filament group on the outside of and partially wrapped around the core, the two groups of filaments being produced from the same or different polymers, characterized in that the sheath filament group comprises at least two filament components, the smaller component of the sheath filament group including fibrils with the coarsest fibril denier and the larger component of the sheath filament group including fibrils with the finer fibril denier, and the finer fibrils of the sheath filament group having finer fibril denier than the fibrils of the core group.

2. False-twist-textured filament yarn according to claim 1, characterized in that the sheath filament group comprises two filament groups with different cross-sections.

3. False-twist-textured filament yarn according to claim 1, characterized in that the synthetic polymers used are selected from the group consisting of polyamides, polyester, and their co-polymers.

4. False-twist-textured filament yarn according to claims 1 to 3, characterized in that the sheath group has a greater number of fibrils than the core group.

5. False-twist-textured filament yarn according to any of claims 1 to 3, characterized in that the coarsest fibrils of the sheath filament group have a fibril denier up to 10 times greater than the finer fibrils.

6. False-twist-textured filament yarn according to any of claims 1 to 3, characterized in that the combination of core and sheath groups has a denier of 50 to 800 dtex.

7. False-twist-textured filament yarn according to any of claims 1 to 3, characterized in that the number of the coarsest fibrils in the sheath group is between 1 and 10.

8. False-twist-textured filament yarn according to any of claims 1 to 3, characterized in that the difference in length between the core filament group and the sheath filament group is between 5% and 25%.

9. False-twist-textured filament yarn according to any of claims 1 to 3, characterized in that the core and sheath filament groups contain entangled filaments.

* * * * *